US012504012B2

(12) United States Patent
Lee et al.

(10) Patent No.: US 12,504,012 B2
(45) Date of Patent: Dec. 23, 2025

(54) ELECTRONIC OIL PUMP

(71) Applicant: COAVIS, Sejong-si (KR)

(72) Inventors: Hyuntae Lee, Sejong-si (KR); Wookeun Lee, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 18/604,051

(22) Filed: Mar. 13, 2024

(65) Prior Publication Data

US 2024/0309868 A1 Sep. 19, 2024

(30) Foreign Application Priority Data

Mar. 14, 2023 (KR) ..... 10-2023-0033291

(51) Int. Cl.

| | |
|---|---|
| ***F04C 2/10*** | (2006.01) |
| ***F01M 1/02*** | (2006.01) |
| ***F01M 11/03*** | (2006.01) |
| ***F04C 15/06*** | (2006.01) |

(52) U.S. Cl.

CPC ..... *F04C 2/103* (2013.01); *F01M 1/02* (2013.01); *F01M 2001/0215* (2013.01); *F01M 2001/0238* (2013.01); *F01M 2001/0292* (2013.01); *F01M 2011/033* (2013.01); *F01M 2011/035* (2013.01); *F04C 15/06* (2013.01); *F04C 15/062* (2013.01); *F04C 2240/20* (2013.01); *F04C 2240/30* (2013.01); *F04C 2240/40* (2013.01); *F04C 2240/60* (2013.01)

(58) Field of Classification Search

CPC combination set(s) only.

See application file for complete search history.

(56) References Cited

U.S. PATENT DOCUMENTS

| | | | | |
|---|---|---|---|---|
| 2006/0140810 | A1* | 6/2006 | Kameya | F04C 2/086 418/61.3 |
| 2013/0071281 | A1* | 3/2013 | Yang | F01C 21/04 418/208 |
| 2014/0241917 | A1* | 8/2014 | Suzuki | F04C 11/008 417/410.4 |
| 2016/0186746 | A1* | 6/2016 | Hikichi | F04C 2/025 60/670 |
| 2017/0067463 | A1* | 3/2017 | Kawano | F04C 15/0038 |
| 2020/0018309 | A1* | 1/2020 | Kobayashi | F04C 2/102 |
| 2020/0291937 | A1* | 9/2020 | Unno | F04C 14/26 |

FOREIGN PATENT DOCUMENTS

KR 101230044 B1 2/2013

* cited by examiner

*Primary Examiner* — Binh Q Tran

(74) *Attorney, Agent, or Firm* — McCoy Russell LLP

(57) ABSTRACT

Provided is an electronic oil pump which may circulate oil by driving an electric motor, and more particularly, an electronic oil pump which may vary a cross-sectional area of a pumping passage based on an oil viscosity, and include a cooling passage for cooling a motor.

5 Claims, 7 Drawing Sheets

[FIG. 1]
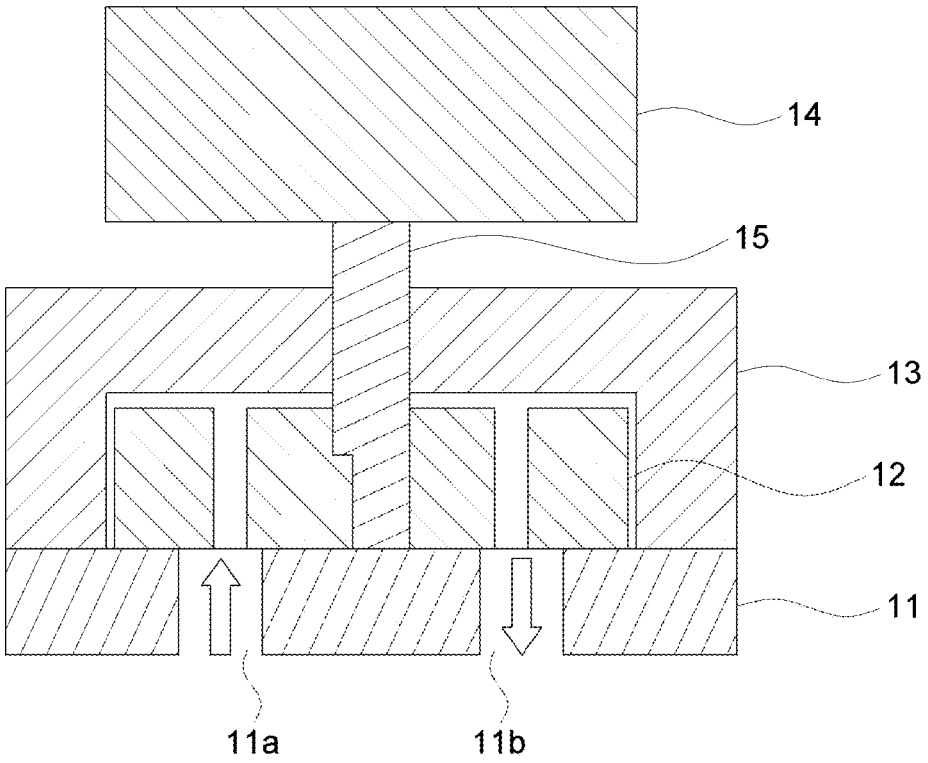

[FIG. 2]
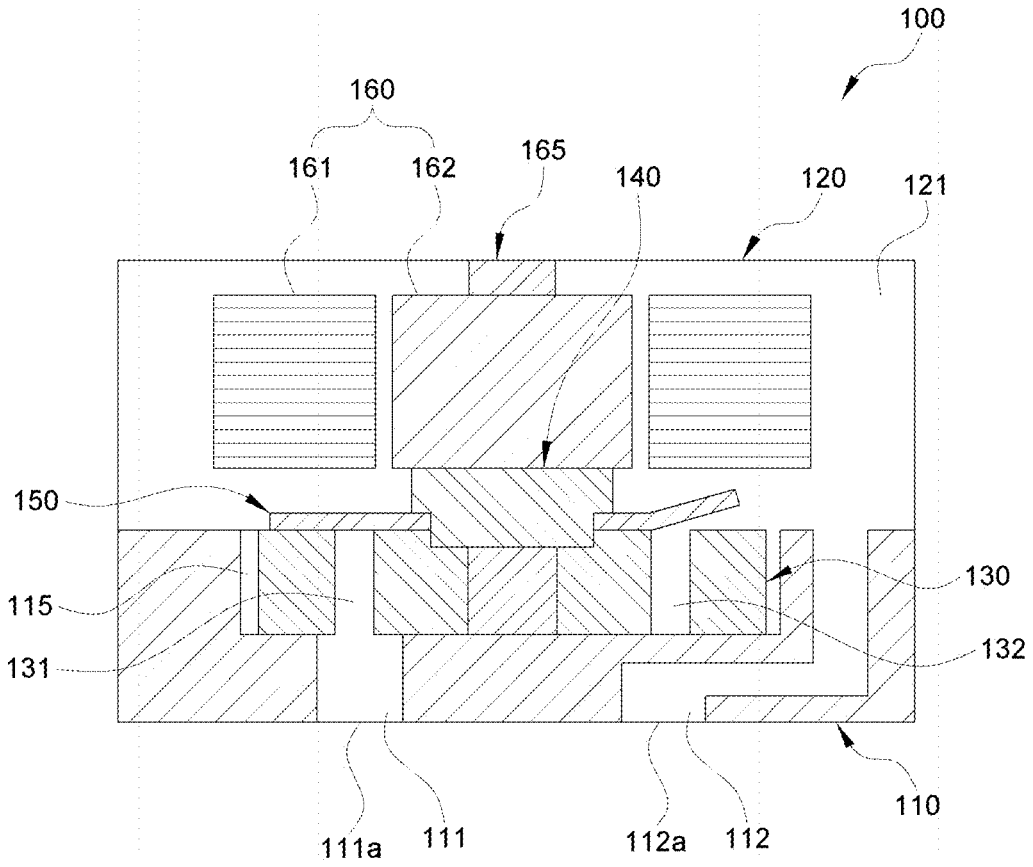

[FIG. 3]
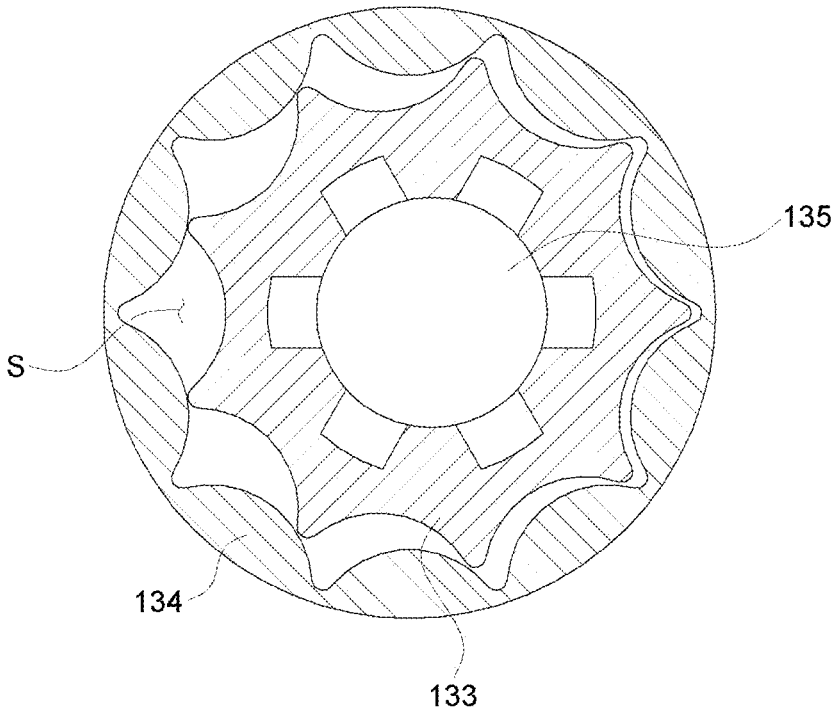

[FIG. 4]
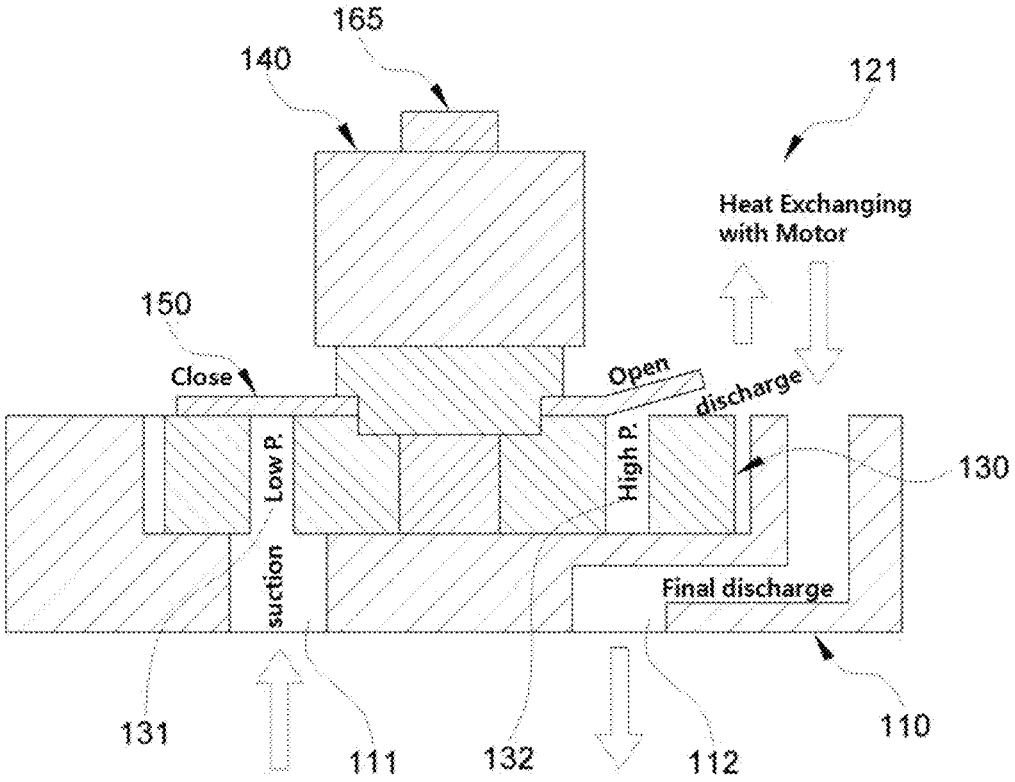

[FIG. 5]
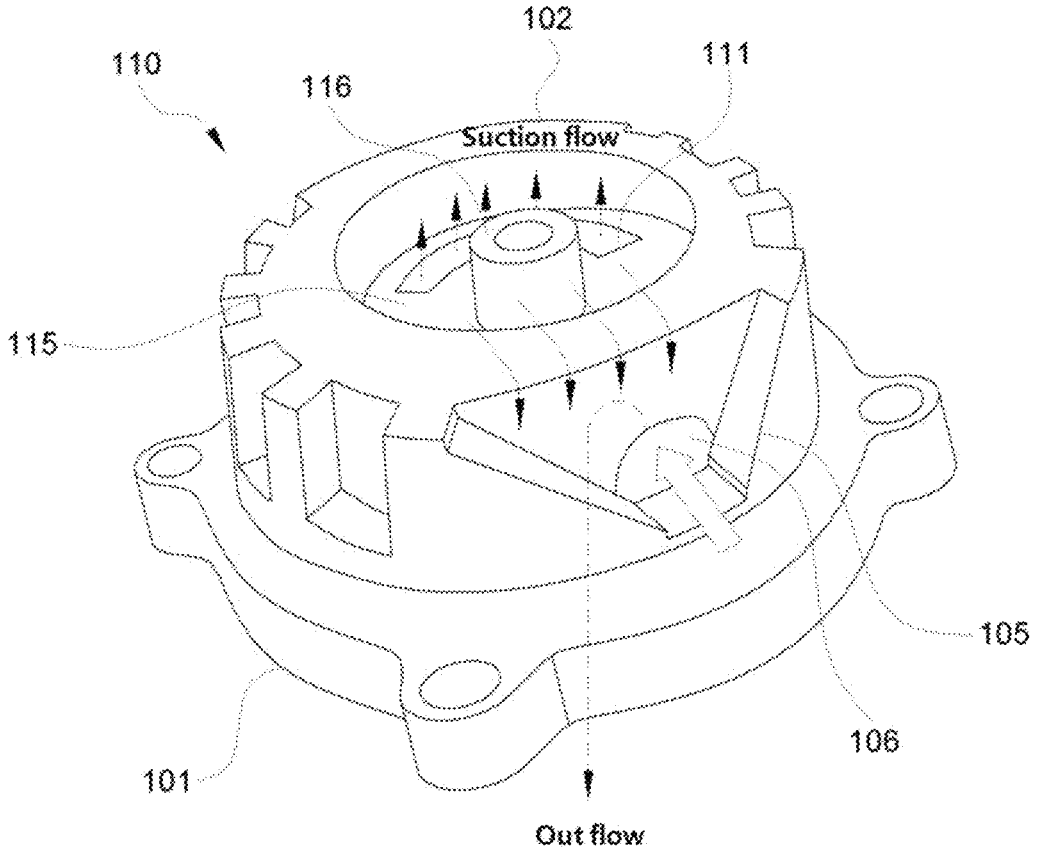

[FIG. 6]
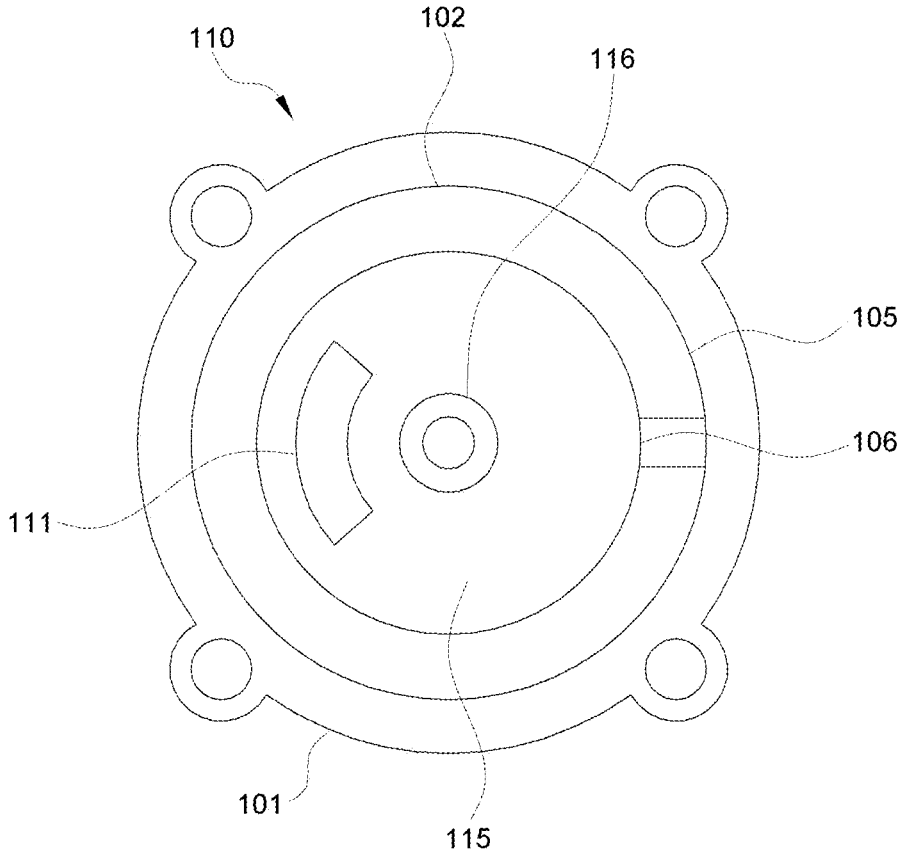

[FIG. 7]
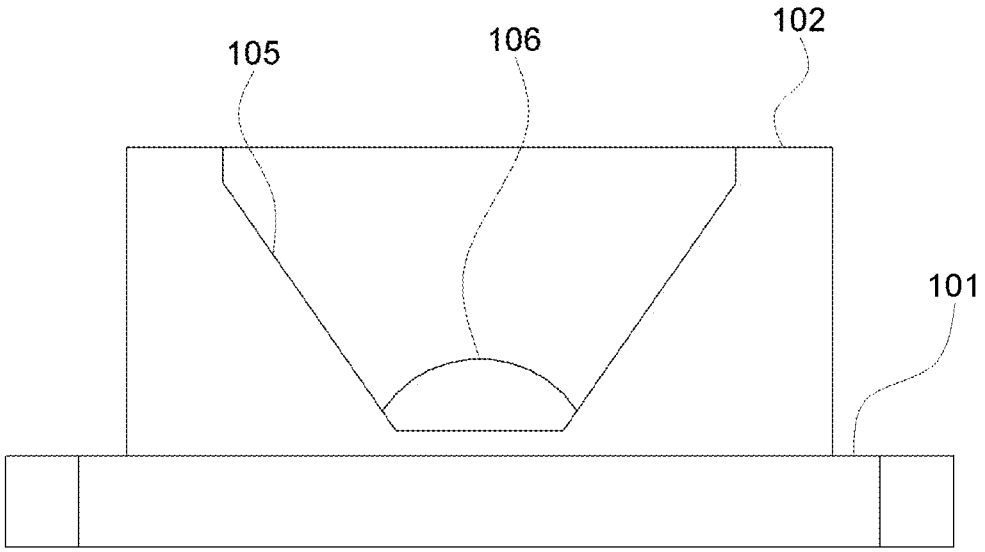

ELECTRONIC OIL PUMP

CROSS-REFERENCE TO RELATED APPLICATIONS

This application claims priority under 35 U.S.C. § 119 to Korean Patent Application No. 10-2023-0033291, filed on Mar. 14, 2023, in the Korean Intellectual Property Office, the disclosure of which is incorporated herein by reference in its entirety.

TECHNICAL FIELD

The following disclosure relates to an electronic oil pump which may circulate oil by driving an electric motor, and more particularly, to an electronic oil pump which may vary a cross-sectional area of a pumping passage based on an oil viscosity, and include a cooling passage for cooling a motor.

BACKGROUND

A vehicle oil pump may be a pump used to circulate oil for lubrication of a vehicle part, such as engine oil or transmission oil. The oil pump may circulate oil into an engine or a transmission to reduce friction between the parts and lubricate the same to reduce wear and maintain its normal operation.

The oil pump installed in an internal combustion engine vehicle may be operated using a rotational force of the engine. In general, the oil pump may be directly connected to a crankshaft of the engine and receive a drive force. The oil pump may be designed to maintain constant pressure and flow rate, and serve an important function in maintaining oil cleanliness and extending a lifespan of the engine when used with an oil filter.

In recent years, an electronic oil pump has also been developed and is being used as the vehicle oil pump. The electric oil pump may make less noise than an existing mechanical pump, and efficiently control oil to perform more efficient lubrication.

In particular, a vehicle having no engine, such as an electric vehicle, may use the electronic oil pump using electricity as its drive source, and the electric motor of the electric vehicle may be operated in a high-temperature, high-speed, and high-pressure environment. Therefore, an internal part of the electric motor may require sufficient lubrication. In addition, a gearbox may use a plurality of gears to transmit power, and require lubrication to maintain a gap between the respective gears and transmit the rotational force. Therefore, the electronic oil pump used in the electric vehicle may be designed to supply lubricating oil necessary for an operation of the electric motor or that of the gearbox.

The oil pump of the electric vehicle may provide appropriate pressure and flow rate while minimizing power consumption and noise, and may be connected to a motor control device to enable precise flow rate control of the lubricating oil. Therefore, the oil pump may be one of important components affecting the driving distance or performance of the electric vehicle.

FIG. 1 is a schematic view showing a main part of a conventional electronic oil pump 10. As shown in the drawing, the oil pump 10 may include a first case 11 having an oil inlet 11*a* and an oil outlet 12*b* formed therein, a second case 12 coupled to the first case 11 and having an oil circulation space therein, a gerotor 13 accommodated in a second case 12 and rotated to suction oil from the oil inlet 11*a* and discharge oil to the oil outlet 11*b*, and a shaft 15 for transmitting a drive force of an electric motor 14 to the gerotor 13.

The conventional electronic oil pump 10 described above has the following problems:

First, it is difficult for the pump to maintain a constant flow rate of oil because oil has a viscosity that varies based on a temperature, a low viscosity in the summer, and a high viscosity in the winter.

Second, the pump may have an increased volume and its manufacturing cost may be increased because a separate cooling means is required to cool heat occurring when driving the motor.

Third, the pump may have a lower pumping efficiency because friction is increased while oil flows due to a narrow region between a gerotor and a case that excludes the inlet and outlet.

Fourth, the pump may have a higher differential pressure when oil flows due to a rapid change in the passage in a case where an oil passage is short and the inlet and outlet are required to be disposed on the same surface.

SUMMARY

An embodiment of the present disclosure is directed to providing an electronic oil pump in which a motor is installed on a pumping passage, thus cooling the motor by using an oil flow.

Another embodiment of the present disclosure is directed to providing an electronic oil pump which may prevent a lower pumping flow rate in such a way that a seal made of a flexible material is installed especially between a gerotor and a motor cooling space for an oil suction side of the gerotor to be sealed by a pressure to thus prevent oil from being discharged to the cooling space, and for a discharge side to be opened by the pressure.

Still another embodiment of the present disclosure is directed to providing an electronic oil pump in which oil supplied to a cooling space is guided to an oil outlet through a passage formed by a shape of a housing.

In one general aspect, provided is an electronic oil pump including: a lower case having one side where the suction passage and discharge passage of a fluid are formed and the other side where a gerotor seating part is formed; an upper case having one side open, having a cooling space formed therein, and having a lower case coupled to an open surface of the one side; a gerotor installed on the seating part, and including an internal rotor and an external rotor engaged with each other to be eccentrically rotated for its one side to communicate with the suction passage and the other side to communicate with the cooling space; an electric motor installed in the cooling space, and including a shaft for transmitting a rotational force to the gerotor; and a flexible seal sealing the other side of the gerotor, and opened by an internal pressure of the gerotor to supply the fluid pumped by the gerotor to the cooling space, wherein the cooling space communicates with the discharge passage for the fluid exchanging heat with the electric motor to be discharged through the discharge passage.

When defining a portion of the gerotor where a volume is increased during its rotation movement as a rotor suction part, and defining a portion of the gerotor where a volume is decreased as a rotor discharge part, the rotor suction part may have one side communicating with the suction passage and the other side exposed to the cooling space and sealed using the flexible seal by the internal pressure, and the rotor discharge part may have one side sealed by the lower case and the other side communicating with the cooling space by the flexible seal opened by the internal pressure.

The flexible seal may be made of an elastic fiber-reinforced plastic material for the rotor discharge part to have an open area that varies based on a fluid viscosity.

The flexible seal may be coupled to the other side of the gerotor and fixed to the shaft to be rotated in conjunction with the gerotor, seal the other side of the rotor suction part by the pressure when the gerotor has an increased volume, and open the other side of the rotor discharge part by the pressure when the gerotor has a decreased volume.

The lower case may include a bottom plate having an upstream end of the suction passage and a downstream end of the discharge passage formed in its one surface; a body extending from the other surface of the bottom plate to the other side, and having a diameter smaller than a diameter of the bottom plate; and the seating part spaced apart from a circumference of the body inward in a radial direction and recessed from the other surface to its one side, and the suction passage and the discharge passage may be formed in the body, a downstream end of the suction passage may pass through the seating part to communicate with the gerotor, and an upstream end of the discharge passage may pass through the circumference of the body to communicate with the cooling space.

The body may include a discharge groove formed therein by a certain distance from the other end of the body to its one side and recessed inward from an outer surface of the body in the radial direction; and a discharge hole passing through the body in the radial direction for one end of the discharge groove and the upstream end of the discharge passage to communicate with each other, and the discharge passage may communicate with the cooling space through the discharge groove and the discharge hole.

The discharge groove may have a tapered shape where its width formed in a circumferential direction of the body gets smaller toward its one side.

Other features and aspects will be apparent from the following detailed description, the drawings, and the claims.

BRIEF DESCRIPTION OF THE DRAWINGS

FIG. 1 is a schematic view of a conventional electronic oil pump.

FIG. 2 is a schematic cross-sectional view of an electronic oil pump according to an embodiment of the present disclosure.

FIG. 3 is a transversal cross-sectional view of a gerotor according to an embodiment of the present disclosure.

FIG. 4 is an enlarged schematic cross-sectional view of a main part of the electronic oil pump according to an embodiment of the present disclosure.

FIG. 5 is a perspective view of a lower case of the electronic oil pump according to an embodiment of the present disclosure.

FIG. 6 is a plan view of the lower case of the electronic oil pump according to an embodiment of the present disclosure.

FIG. 7 is a side view of the lower case of the electronic oil pump according to an embodiment of the present disclosure.

DETAILED DESCRIPTION OF EMBODIMENTS

Hereinafter, an embodiment of the present disclosure is described in detail with reference to the accompanying drawings.

FIG. 2 is a schematic cross-sectional view of an electronic oil pump 100 according to an embodiment of the present disclosure; and FIG. 3 is a transversal cross-sectional view of a gerotor 130 according to an embodiment of the present disclosure. The description is provided by defining a lower side of the drawing in FIG. 2 as one side and an upper side of the drawing as the other side.

As shown in FIG. 2, the oil pump 100 may include a lower case 110, an upper case 120, the gerotor 130, a coupling 140, a flexible seal 150, and an electric motor 160.

The lower case 110 may be disposed on one side of the oil pump 100, and have a suction passage 111 and a discharge passage 112 formed therein. In addition, the lower case 110 may have one surface where a suction port, which is an upstream side of the suction passage 111, and a discharge port, which is a downstream side of the discharge passage 112, are formed. In addition, the lower case 110 may have a seating part 115 on which the gerotor 130 is seated therein. The seating part 115 may be recessed from the other surface of the lower case 110 to one side. A shaft fixing part 116 (see FIG. 4) to which a shaft 165 of the electric motor 160, the shaft capable of rotating the gerotor 130, is rotatably fixed may be formed at the center of a lower surface of the seating part 115.

The upper case 120 may have a box shape with one side open, and have a cooling space 121 where the electric motor 160 is installed therein. The upper case 120 may seal an open surface of its one side by being coupled with the lower case 110. The cooling space 121 of the upper case 120 may communicate with an upstream side of the discharge passage 112. Therefore, oil supplied to the cooling space 121 may be discharged to the outside through the discharge passage 112.

Referring to FIG. 3, the gerotor 130 may include an internal rotor 133 and an external rotor 134. The gerotor 130 may be rotated with a rotation ratio of (N+1)/N in a state where the internal rotor 133 has N lobes, and the external rotor 134 has N+1 lobes. In addition, the internal rotor 133 and the external rotor 134 may have a constant eccentricity centered on an eccentric hole 135, and the eccentricity may provide a volumetric part S in which a fluid fuel may be transported between the internal rotor 133 and the external rotor 134. The volumetric part S may repeat its increase and decrease during its rotation, and have a volume change rate determined by a tooth profile of the rotated rotor. During a rotation movement of the rotor, a portion of the volumetric part S where a volume is increased may suction a surrounding fluid due to a pressure drop, and its portion where the volume is decreased may discharge the fluid due to a pressure rise. As described above, the gerotor 130 may transport the fluid by the increase and decrease of the volumetric part S, and for convenience, the description defines the portion where the volume is increased as a rotor suction part 131 and the portion where the volume is decreased as a rotor discharge part 132.

As shown in FIG. 2, the gerotor 130 may be seated on the seating part 115 of the lower case 110 and coupled to the shaft 165 to thus allow the internal rotor 133 or the external rotor 134 to be rotated by driving the shaft 165. Here, the rotor suction part 131 may have one side communicating with the suction passage 111, and the other side exposed to the cooling space 121 while having the flexible seal 150 therebetween. In addition, the rotor discharge part 132 may have one side sealed by the lower case 110, and the other side exposed to the cooling space 121 while having the flexible seal 150 therebetween.

As described above, the flexible seal 150 may have a disk shape and surround the other side of the gerotor 130. In addition, the flexible seal 150 may be coupled and fixed to the shaft 165 through the coupling 140. Therefore, the flexible seal 150 may be rotated in conjunction with the rotation of the shaft 165 while surrounding the other side of the gerotor 130. Here, the flexible seal 150 may be made of a flexible material, the flexible seal 150 disposed in the rotor suction part 131 may seal the other side of the rotor suction part 131 as the rotor suction part 131 has a reduced pressure, and the flexible seal 150 disposed in the rotor discharge part 132 may open the other side of the rotor discharge part 132 as the rotor discharge part 132 has an increased pressure.

Through the above configuration, the rotor suction part 131 may have an improved suction efficiency in suctioning oil from the suction passage 111 as being blocked from the cooling space 121 by using the flexible seal 150, and the rotor discharge part 132 may discharge oil suctioned into the cooling space 121 as the flexible seal 150 is opened. In addition, the rotor discharge part 132 may have an open area that varies based on an oil viscosity when the flexible seal 150 is opened, and oil may always be discharged at a constant flow rate regardless of the oil viscosity.

The electric motor 160 may include a stator 161 fixed to the upper case 120 in the cooling space 121, and a rotor 162 installed inside the stator 161 and rotated by an electricity supply. In addition, the shaft 165 may be coupled to the rotor 162 to transmit a rotational force of the rotor 162 to the gerotor 130. In addition, the electric motor 160 may be cooled through its heat exchange with oil discharged from the rotor discharge part 132.

FIG. 4 is an enlarged schematic cross-sectional view of a main part of the electronic oil pump 100 according to an embodiment of the present disclosure. The oil flow is described in more detail with reference to FIG. 4.

When the gerotor 130 is rotated by the shaft 165, the rotor suction part 131 where the volumetric part S is increased may have a low pressure formed therein to thus suction oil through the suction passage 111. Here, the other side of the rotor suction part 131 may be sealed by the flexible seal 150 and blocked from the cooling space 121 to thus prevent a lower oil suction performance. In addition, the rotor discharge part 132 where the volumetric part S is decreased may have a high pressure formed therein to thus discharge oil suctioned into the volumetric part S. As one side of the rotor discharge part 132 may be sealed by the lower case 110, the flexible seal 150 surrounding the other side of the rotor discharge part 132 may be opened by the high pressure, thereby discharging oil stored in the volumetric part S to the cooling space 121. Oil discharged to the cooling space 121 may cool the electric motor 160 heated for a certain time, and then flow into the discharge passage 112 of the lower case 110 that communicates with the cooling space 121 to thus be finally pumped through the discharge port.

FIG. 5 is a perspective view of the lower case 110 of the electronic oil pump 100 according to an embodiment of the present disclosure; and FIG. 6 is a plan view of the lower case 110 of the electronic oil pump 100 according to an embodiment of the present disclosure. In addition, FIG. 7 is a side view of the lower case 110 of the electronic oil pump 100 according to an embodiment of the present disclosure.

As shown in the drawings, the lower case 110 may include a bottom plate 101 having the suction passage 111 and the discharge passage 112 formed therein, and a body 102 having a smaller diameter than that of the bottom plate 101 and protruding to the other side of the bottom plate 101. The upper case 120 may have one end in contact with and coupled to a circumference of the other side of the bottom plate 101, and an inner surface of one end in contact with and coupled to an outer surface of the body 102.

The body 102 may include the seating part 115 recessed from the other surface to its one side, and a downstream end of the suction passage 111 may communicate with one surface of the seating part 115. In addition, the shaft fixing part 116, to which the shaft 165 is rotatably fixed, may be formed at the center of one surface of the seating part 115.

Here, a discharge groove 105 allowing the cooling space 121 and the discharge passage 112 to communicate with each other may be formed in the body 102. The discharge groove 105 may be recessed inward from an outer surface of the body 102 in a radial direction. In addition, the discharge groove 105 may be formed from the other surface of the body 102 to its one surface in a length direction. In addition, the discharge groove 105 may have a tapered shape where its width in a circumferential direction of the body gets smaller toward its one side. In addition, the body 102 may include a discharge hole 106 passing through the body 102 in the radial direction for one end of the discharge groove 105 and the upstream end of the discharge passage 112 to communicate with each other.

Through the above configuration, the pump may have the discharge groove 105 and the discharge hole 106 formed therein by molding of the lower case 110, without any separate passage, thereby transmitting oil in the cooling space 121 to the discharge passage 112 formed in the lower case 110.

As set forth above, the electronic oil pump having the above configuration according to the present disclosure may have the smaller size and the lower manufacturing costs because the motor is cooled by the pumped oil, and accordingly, the pump does not require any separate cooling means for cooling the motor.

In addition, the pump may easily pump oil at the constant flow rate even when the oil viscosity is changed by varying the cross-sectional area of the passage that varies based on the oil viscosity by using the seal made of the flexible material.

In addition, the pump may have the increased pumping efficiency because the gerotor and the motor cooling space communicate with each other to thus minimize the narrow region between the gerotor and the case, thereby reducing the friction occurring while oil flows.

In addition, the pump may have the lower differential pressure when oil flows because the oil passage includes the cooling space, and the flexible passage may thus be formed even in a case where the inlet and outlet are disposed on the same surface.

The spirit of the present disclosure should not be limited to an embodiment described above. The present disclosure may be applied to various fields and may be variously modified by those skilled in the art without departing from the scope of the present disclosure claimed in the claims. Therefore, it is obvious to those skilled in the art that these alterations and modifications fall within the scope of the present disclosure.

DETAILED DESCRIPTION OF MAIN ELEMENTS

100: oil pump
110: lower case
101: bottom plate
102: body
105: discharge groove
106: discharge hole

111: suction passage
112: discharge passage
115: seating part
116: shaft fixing part
120: upper case
121: cooling space
130: gerotor
131: rotor suction part
132: rotor discharge part
133: internal rotor
134: external rotor
135: eccentric hole
140: coupling
150: flexible seal
160: electric motor
161: stator
162: rotor
165: shaft

What is claimed is:

1. An electronic oil pump comprising:

a lower case having one side where the suction passage and discharge passage of a fluid are formed and the other side where a gerotor seating part is formed;

an upper case having one side open, having a cooling space formed therein, and having a lower case coupled to an open surface of the one side;

a gerotor installed on the seating part, and including an internal rotor and an external rotor engaged with each other to be eccentrically rotated for its one side to communicate with the suction passage and the other side to communicate with the cooling space;

an electric motor installed in the cooling space, and including a shaft for transmitting a rotational force to the gerotor; and a flexible seal sealing the other side of the gerotor, and opened by an internal pressure of the gerotor to supply the fluid pumped by the gerotor to the cooling space, wherein the cooling space communicates with the discharge passage for the fluid exchanging heat with the electric motor to be discharged through the discharge passage, wherein the lower case includes:

a bottom plate having an upstream end of the suction passage and a downstream end of the discharge passage formed in its one surface;

a body extending from the other surface of the bottom plate to the other side, and having a diameter smaller than a diameter of the bottom plate; and the seating part spaced apart from a circumference of the body inward in a radial direction and recessed from the other surface to its one side, and the suction passage and the discharge passage are formed in the body, a downstream end of the suction passage passes through the seating part to communicate with the gerotor, and an upstream end of the discharge passage passes through the circumference of the body to communicate with the cooling space, wherein the body includes:

a discharge groove formed therein by a certain distance from the other end of the body to its one side and recessed inward from an outer surface of the body in the radial direction; and a discharge hole passing through the body in the radial direction for one end of the discharge groove and the upstream end of the discharge passage to communicate with each other, and the discharge passage communicates with the cooling space through the discharge groove and the discharge hole.

2. The pump of claim 1, wherein when defining a portion of the gerotor where a volume is increased during its rotation movement as a rotor suction part, and defining a portion of the gerotor where a volume is decreased as a rotor discharge part, the rotor suction part has one side communicating with the suction passage and the other side exposed to the cooling space and sealed using the flexible seal by the internal pressure, and the rotor discharge part has one side sealed by the lower case and the other side communicating with the cooling space by the flexible seal opened by the internal pressure.

3. The pump of claim 1, wherein the flexible seal is made of an elastic fiber-reinforced plastic material for the rotor discharge part to have an open area that varies based on a fluid viscosity.

4. The pump of claim 1, wherein the flexible seal is coupled to the other side of the gerotor and fixed to the shaft to be rotated in conjunction with the gerotor, seals the other side of the rotor suction part by the pressure when the gerotor has an increased volume, and opens the other side of the rotor discharge part by the pressure when the gerotor has a decreased volume.

5. The pump of claim 1, wherein the discharge groove has a tapered shape where its width formed in a circumferential direction of the body gets smaller toward its one side.

* * * * *